US005094647A

United States Patent [19]

Courtney

[11] Patent Number: 5,094,647

[45] Date of Patent: Mar. 10, 1992

[54] NURSING GARMENT

[76] Inventor: Rebecca S. Courtney, 3 Granby Rd., Landenberg, Pa. 19350

[21] Appl. No.: 672,408

[22] Filed: Mar. 20, 1991

[51] Int. Cl.[5] ..... A41C 3/04

[52] U.S. Cl. ..... 450/36; 450/1; 2/104

[58] Field of Search ..... 450/31, 32, 36, 38, 450/37, 41, 53, 54, 55, 56, 57, 60, 68; 2/104, 73

[56] References Cited

U.S. PATENT DOCUMENTS 3,773,052 11/1973 Belardinelli ..... 450/36 X
4,423,734 1/1984 Schawel ..... 450/37
4,633,876 1/1987 Scullin ..... 450/36
4,878,879 11/1989 Kunstadter ..... 450/36

*Primary Examiner*—Werner H. Schroeder
*Assistant Examiner*—Jeanette E. Chapman
*Attorney, Agent, or Firm*—Connelly & Hutz

[57] ABSTRACT

A nursing garment preferably in the form of a bra includes at least one cup which fits over a breast of the user. The cup includes a flap for selectively concealing or exposing the breast. When the flap is open the breast is exposed for nursing purposes. A focus pattern is provided on the cup located so that it can be viewed by the infant during nursing.

14 Claims, 1 Drawing Sheet

NURSING GARMENT

BACKGROUND OF INVENTION

Various types of garments exist which are intended for use by mothers to facilitate the nursing of an infant. Such garments generally take the form of nursing bras, although other types of garments such as slips could also be used for nursing purposes. With such garments, the breasts are selectively concealed and exposed by means of flaps located at the cup portion of the garment covering the breasts. When it is desired to nurse the infant the flap would be opened and the breast would be exposed so that the infant could readily nurse. During other periods the flap would be closed and the breast would be concealed.

There has been a recent awareness that focus patterns are beneficial in the development of an infant. For example, when an infant may view a focus pattern it is believed that the infant's eyesight will become developed more quickly. It is additionally believed that focus patterns might also stimulate the infant's mind to facilitate a more rapid mental development. Such focus patterns generally take the form of contrasting colors, such as black and white, although other colors may be used. The focus patterns are a geometric shape frequently in a repetitive pattern. It has been found that these focus patterns serve to attract the attention of an infant even at an extremely early age. The fascination of the focus pattern by the infant results in the infant concentrating on the pattern which in turn helps develop the infant's eyesight as well as stimulating the infants mind. Heretofore, such focus patterns have generally been used, for example, with mobiles or on or near the infant's crib.

SUMMARY OF INVENTION

An object of this invention is to take advantage of the benefits obtained from focus patterns and combine those benefits with the nursing activities of an infant.

A further object of this invention is to provide a nursing garment which incorporates focus patterns so that the infant may view the focus patterns during nursing.

In accordance with this invention the nursing garment is preferably in the form of a nursing bra of generally conventional construction which includes a flap selectively opening and closing a cup for selectively exposing and concealing a breast. A nursing pattern is provided on the upper portion of the cup so that when the flap is open and the infant nurses, the nursing pattern will be readily visible.

In the preferred practice of this invention the focus pattern is concealed by the flap when the flap is in the closed condition so that the focus pattern will not be readily apparent through an outer garment of the mother when the inner garment is not being used for nursing purposes. In the preferred practice of this invention, multiple focus patterns are provided on each cup. The patterns may be of contrasting colors, such as black and white or of other forms of contrasting colors. If desired, a plurality of different patterns may be provided for detachable securement or removal from the garment to provide a selection of different patterns for the infant.

THE DRAWINGS

FIG. 1 is a front elevational view of a nursing garment in accordance with this invention; and FIGS. 2-3 are front elevational views of alternate focus patterns which may be used on the garment of FIG. 1.

DETAILED DESCRIPTION

Figure 1:
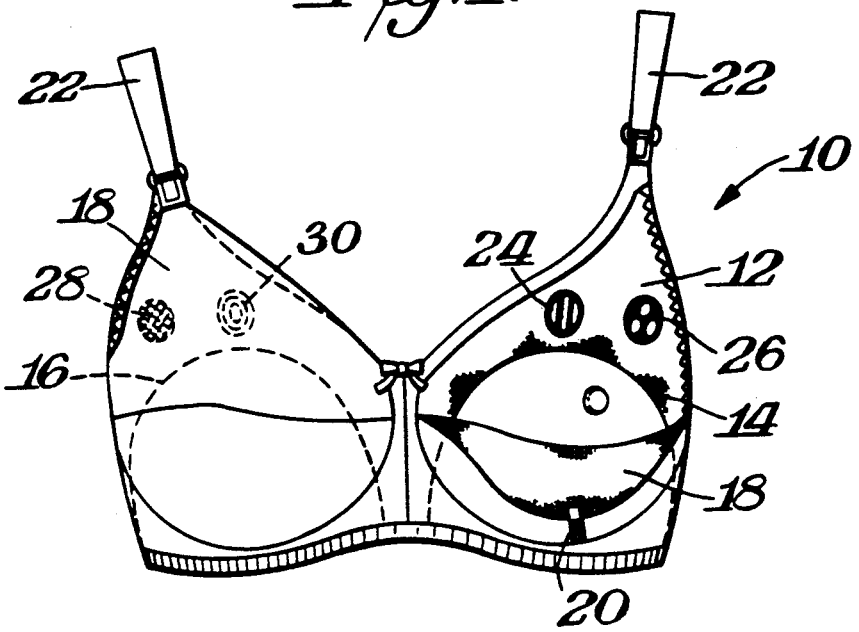

The present invention relates to a nursing garment which may generally take any conventional form, such as a bra or slip. FIG. 1 illustrates garment 10 to be in the form of a nursing bra. As shown therein, the front member 12 of bra 10 includes a pair of cup portions 14,16, each of which is provided with a flap 18. Flap 18 includes a fastener 20 of any suitable construction such as the hook and loop construction marketed under the name VELCRO. Fastener 20 thereby permits the selective concealing and exposing of its breast in accordance with whether the flap is in its open or closed position. Thus, when it is intended to nurse an infant, flap 18 would be opened and the breast in cup 14 would be exposed so that an infant could readily nurse, as shown in FIG. 1.

Bra 12 would also enclose a back member, such as straps which extend around the user's back and over the user's shoulders for securing the bra to the user. The shoulder straps are indicated by the reference numeral 22. The structure, heretofore described is of conventional form. Reference in this respect is made to U.S. Pat. Nos. 3,773,052; 4,446,572; and 4,648,404 which exemplify different types of prior art nursing garments.

The present invention involves an improvement over such nursing garments by the incorporation of focus patterns on each nursing cup. FIG. 1, for example, illustrates a set of two focus patterns 24,26 on cup 14 with a second set of focus patterns 28,30 on cup 16. As illustrated, each of the focus patterns differs from all others. The invention, however, may be practiced where all of the focus patterns are identical. Further, the invention may be practiced with only one focus pattern on each cup or with more than two focus patterns on each cup.

Figure 2:
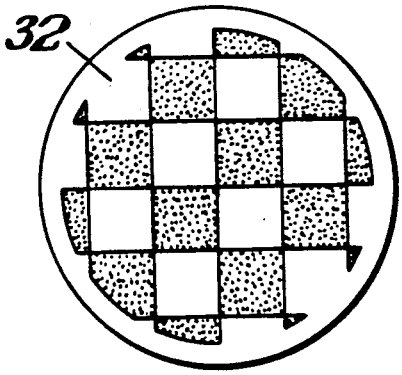
Figure 3:
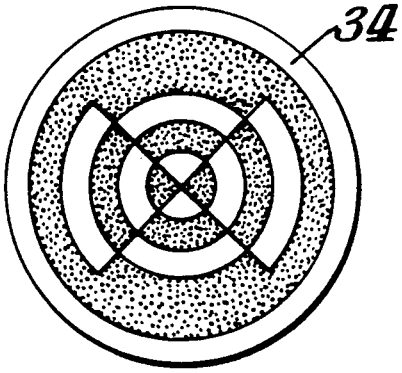

FIGS. 2-3 illustrate other types of focus patterns 32,34 which may be usable with the invention. In general, the focus patterns are characterized by being made of contrasting colors. For very young infants it is preferred that the colors be black and white. For older nursing children contrasting colors other than black and white may be used. The invention is preferably practiced by having the focus patterns permanently formed on the garment 10. It is within the scope of the invention, however, to make the focus patterns detachable so that the type, number and location of the focus patterns could be varied. Such detachability could be achieved in any suitable manner, including the use of hook and loop formations or low tack adhesives.

An important feature in the preferred practice of the invention is that the focus patterns are located at the upper portion of each cup where the patterns will be concealed when the flap 18 is moved to its closed position as shown for cup 16. The advantage of concealing the focus patterns during periods when the infant is not nursing is that the mother may wear the garment without having the focus patterns visible through an outer garment, such as a blouse or skirt, particularly a blouse or skirt made of a light or translucent type color.

In the preferred practice of the invention, the focus patterns are provided for each nursing cup. It is to be recognized, however, that in some instances where for physical reasons only one breast is used for nursing purposes, that the invention in those instances may be practiced by having the focus patterns on only the single nursing cup.

In use the mother would manipulate fastener 20 so that flap 18 could be lowered to its open position thereby exposing the breast. Upon opening flap 18 the focus patterns would also become visible. Since the focus patterns are located at the upper portion of the cup the focus patterns would be within the line of vision of the infant when the infant is in the normal nursing position. After the infant has sufficiently nursed, flap 18 is moved to its closed position and maintained in that position by proper manipulation of fastener 20. When in the closed position, the focus patterns are again concealed.

It is to be understood that the invention may be practiced with various types of fasteners, such as clips, hooks and pins. Further, the focus patterns need not be concealed by the flap in the broad practice of the invention where the nursing garment is worn only for nursing purposes or where the nursing garment is worn beneath an outer garment of opaque color. The focus patterns need not be concealed when the mother is wearing light colored or translucent type outer garments in instances where the mother considers the focus patterns to add some attractiveness to the apparel. The focus patterns could remain permanently visible by using a smaller flap 18 or by locating the patterns closer to straps 22.

What is claimed is:

1. In a nursing garment having a front section and a back section connected to said front section for fitting on a nursing mother, at least one nursing cup on said front section for fitting over a breast of the nursing mother, a flap mounted to said nursing cup and selectively movable to and from closed and open positions, the breast being concealed when said flap is in said closed position, and the breast being exposed when said flap is in said open position to permit the nursing of an infant, the improvement being in at least one focus pattern at said nursing cup disposed for viewing by the infant while the infant is nursing, and said focus pattern being defined by clusters of solid colored area with juxtaposed areas being of contrasting colors.

2. The garment of claim 1 wherein said focus pattern is at the upper portion of said cup.

3. The garment of claim 2 wherein there are two of said nursing cups, and at least one of said focus patterns being at each of said cups.

4. The garment of claim 3 wherein each of said focus patterns is concealed by its respective flap when said flap is in said closed position.

5. The garment of claim 4 wherein a plurality of said focus patterns is at each of said nursing cups.

6. In a nursing garment having a front section and a back section connected to said front section for fitting on a nursing mother, at least one nursing cup on said front section for fitting over a breast of the nursing mother, a flap mounted to said nursing cup and selectively movable to and from closed and open positions, the breast being concealed when said flap is in said closed position, and the breast being exposed when said flap is in said open position to permit the nursing of an infant, the improvement being in at least one focus pattern at said nursing cup disposed for viewing by the infant while the infant is nursing, said focus pattern being at the upper portion of said cup, there being two of said nursing cups, at least one of said focus patterns being at each of said cups, each of said focus patterns being concealed by its respective flap when said flap is in said closed position, a plurality of said focus patterns being at each of said nursing cups, and each of said focus patterns differing from the other of said focus patterns.

7. The garment of claim 6 wherein said focus patterns are detachably mounted to said cups.

8. The garment of claim 7 wherein said focus patterns are geometric patterns of contrasting colors.

9. The garment of claim 8 wherein said colors are black and white.

10. The garment of claim 8 wherein said contrasting colors are light and dark colors other than black and white.

11. The garment of claim 8 wherein said garment is a bra.

12. The garment of claim 1 wherein each of said focus patterns is concealed by its, respective flap when said flap is in said closed position.

13. The garment of claim 1 wherein a plurality of said focus patterns is at each of said nursing cups.

14. In a nursing garment having a front section and a back section connected to said front section for fitting on a nursing mother, at least one nursing cup on said front section for fitting over a breast of the nursing mother, a flap mounted to said nursing cup and selectively movable to and from closed and open positions, the breast being concealed when said flap is in said closed position, and the breast being exposed when said flap is in said open position to permit the nursing of an infant, the improvement being in at least one focus pattern at said nursing cup disposed for viewing by the infant while the infant is nursing, a plurality of said focus patterns being at each of said nursing cups, and each of said focus patterns differing from the other of said focus patterns.

* * * * *